US006283707B1

(12) United States Patent
Chin

(10) Patent No.: US 6,283,707 B1
(45) Date of Patent: Sep. 4, 2001

(54) AEROFOIL BLADE DAMPER

(75) Inventor: Kevin Chin, Houston, TX (US)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/520,619

(22) Filed: Mar. 7, 2000

(30) Foreign Application Priority Data

Mar. 19, 1999 (GB) ..... 9906450

(51) Int. Cl.[7] ..... B63H 1/14; B64C 11/16
(52) U.S. Cl. ..... 416/96 A; 416/248; 416/500
(58) Field of Search ..... 416/96 A, 232, 416/233, 229 R, 248, 500

(56) References Cited

U.S. PATENT DOCUMENTS

| | | | | |
|---|---|---|---|---|
| 1,833,751 | * | 11/1931 | Kimball | 416/232 X |
| 1,833,754 | * | 11/1931 | Paget | 416/500 X |
| 2,559,131 | * | 7/1951 | Oestrich et al. | 416/96 A X |
| 2,642,263 | * | 6/1953 | Thorp, II | 416/233 |
| 2,689,107 | * | 9/1954 | Odegaard | 416/233 |
| 3,027,138 | * | 3/1962 | Howell et al. | 416/500 X |
| 4,526,512 | | 7/1985 | Hook . | |
| 5,205,714 | | 4/1993 | Shah . | |
| 5,407,321 | * | 4/1995 | Rimkunas et al. | 416/500 X |
| 5,558,497 | | 9/1996 | Kraft . | |
| 5,820,343 | * | 10/1998 | Kraft et al. | 416/96 A |

FOREIGN PATENT DOCUMENTS

| | | |
|---|---|---|
| B1 891635 | 2/1942 | (FR) . |
| B1 347964 | 5/1931 | (GB) . |

* cited by examiner

*Primary Examiner*—John E. Ryznic
(74) *Attorney, Agent, or Firm*—W. Warren Taltavull; Manelli Denison & Selter PLLC

(57) ABSTRACT

An aerofoil blade damper comprising an elongate member which is inserted within a core passage of the blade and extends within the blade with the damper retained therein at one end which is closest to the blade root with the remainder of the damper free to move relative to and within the passage; such movement generating friction which dissipates any vibration. The damper comprises a plate insert including at least two discrete substantially oppositely directed contact regions which are arranged, in use, to frictionally engage the passage. The discrete contact regions may be provided by protrusions in the form of contact pads or arms extending from the plate or be provided by the corrugations of the plate. A contact load on the contact regions is provided by the resilience of the damper, an interference fit of the damper and/or centrifugal loading of the damper and contact regions during operation.

26 Claims, 5 Drawing Sheets

AEROFOIL BLADE DAMPER

FIELD OF THE INVENTION

This invention relates to a damper for aerofoil blades and in particular a damper for aerofoil blades mounted on a rotatable disc.

BACKGROUND OF THE INVENTION

Gas turbine engines for aircraft, marine and land use typically have axial flow turbines that comprise a number rotatable discs, each of which carries an annular array of radially extending aerofoil blades on its periphery. Each aerofoil blade is provided with a root portion by means of which it is attached to its associated disc. While such a method of attachment is effective in ensuring the integrity of each blade/disc assembly, problems can still arise as a result of aerofoil blade vibration. Such vibration, if unchecked, leads to reduction in blade life and in some cases rapid damage to the blades, possibly resulting in blade failure.

Aerofoil blades commonly vibrate in a number of different modes including flap, torsional and edgewise modes. In the torsional mode of vibration, each aerofoil blade tends to twist about its longitudinal axis. In the flap mode, each aerofoil blade flaps in a generally circumferential direction. In edgewise mode each aerofoil blade tends to rock axially forward and rearward (with respect to the axis of rotation of the disc on which the aerofoil blades are mounted).

It is well known to combat flap and torsional modes of aerofoil blade vibration by the provision of damping members that are configured and positioned so that one damping member spans the undersides of the platforms of circumferentially adjacent aerofoil blades. Centrifugal loading due to disc rotation urges the damping members into engagement with the platform undersides. Damping is provided by frictional interaction between the dampers and blade platforms. Such a damper is described in EP 0,509,838, and U.S. Pat. No. 5,478,207 among many others.

While such damper members are effective in damping torsional and flap modes of vibration, they are less effective in dealing with edgewise modes of vibration.

Another proposed damping arrangement is described in GB 2078,310. In this proposal a pin is introduced within a slightly off radial extending passage provided in the aerofoil blade. This pin is retained at the blade root end whilst being free to slide within the passage. Vibration of the blade causes relative sliding movement of the pin within the passage. The friction generated will absorb energy and will then tend to damp out the vibration of the blade.

The damping provided by this arrangement is not particularly effective and the arrangement proposed requires separate passages to be provided within the blade. Furthermore, to provide adequate damping the pin has an interference fit within the passage over a substantial length and surface of the pin. This interference fit provides a loading against the sides of the passage to produce the required friction to damp the vibration. This arrangement, however, makes it difficult to fit the pin within the aerofoil blade.

It is therefore desirable to provide an aerofoil blade damper which is so configured as to provide improved effective damping of aerofoil blade vibration.

SUMMARY OF THE INVENTION

According to the present invention there is provided an aerofoil blade damper for use with an aerofoil blade which has blade root and a core passage defined in the blade root and blade which extends within the blade root and blade, the damper comprising an elongate member which in use is arranged to be inserted within a core passage, the damper being arranged to be retained in the blade at one end which is closest to the blade root with the remainder of the damper free to move relative to and within the passage; wherein the damper comprises a resilient plate insert upon which there are provided at least two discrete substantially oppositely directed contact regions which are arranged, in use, to frictionally engage the passage.

A damper which is inserted within a blade core passage incorporates discrete contact regions which provide improved damping. The discrete contact regions allow increased contact loads to be used whilst still allowing the required relative vibration induced sliding of the damper within the passage and allowing the damper to be relatively easily inserted within the passage. The increased contact loads generate increased friction which dissipates more vibrational energy so providing improved vibration damping.

Preferably the resilience of the damper is arranged to permit the damper to bend to conform to the shape of the blade passage within which the damper is arranged to be inserted. The resilience of the damper may be arranged such that the contact regions of the damper are urged against the sides of the passages and provides a contact load between the contact regions and the blade passage, when the damper is inserted within the blade passage.

Preferably in use the blade and damper are arranged to rotate about a rotational axis and the damper is arranged in use and is sufficiently resilient that centrifugal forces caused by the rotation bend and deflect at least a part of the damper to urge the contact regions against the sides of the passages.

The plate insert may be corrugated with the corrugations disposed transversely across the plate. Alternatively the corrugations may be disposed at an angle relative to an axis of the plate. The corrugations may also alternatively be disposed longitudinally. The contact regions may preferably comprise the maximum and minimum extents of the corrugations which are arranged in use to frictionally engage the passage.

A corrugated plate damper provides multiple contact regions and is simple to fabricate.

The contact regions may comprise protrusions from the plate insert. The protrusions may comprise arcuate profiled pads where the thickness of the plate insert is increased.

Preferably the protrusions comprise flexible arms extending from the plate insert, with the distil ends of the arms arranged in use to frictionally engage the passage. The arms may be angled in the direction of the end of the damper arranged to be closest to the blade root.

In operation centrifugal loading of the arms angled in the direction of the root end of the damper will, in use, urge the arms and contact regions on the ends of the arms into further engagement with the passage. This provides or increases the contact load on the contact regions, providing or increasing the friction generated under vibration induced sliding of the contact regions. This improves the dissipation of the vibrational energy and damping provided by such a damper.

An additional mass may be provided at each of the distil ends of the arms.

The additional mass on each of the ends of the arms increases the centrifugal loading produced on the contact regions under operation.

The protrusions may extend from only one side of the plate, the protrusions and the opposite side of the plate arranged to provide the contact regions which, in use, frictionally engage the passage.

Preferably the successive contact regions are arranged alternately along the length of the damper.

Preferably the damper is arranged to be used with a turbine blade. Furthermore the core passage within which the damper is arranged to be inserted may comprise a cooling passage within an aerofoil blade.

By arranging the damper so that it can be inserted within the cooling passages of a turbine blade separate passages for the damper do not need to be provided within the blade. This simplifies the overall design and improves the integrity of the blade within which the damper is arranged to fit.

Alternatively the core passage within which the damper is arranged to be inserted may comprise a dedicated passage within an aerofoil blade for the damper.

Preferably at the end of the damper arranged to be closest to the blade root a head portion extends from the plate insert and is arranged to span the width of the passage to thereby provide retention of the damper when inserted into a blade.

The head portion provides a simple and secure means for locating the root end of the damper.

Preferably the head portion and damper are arranged to allow an airflow through the passage. The cross sectional area, perpendicular to the length of the damper, of a portion of the damper arranged to be inserted within the passage may preferably be less than the cross sectional area of the passage, perpendicular to the longitudinal direction of the passage, and within which the damper is arranged to be inserted.

The core passage within which the damper is arranged to be inserted may be curved. The damper may also or alternatively be curved along its length.

Preferably the damper is resilient and bends to the conform to the shape of the core passage within which it is arranged to be inserted.

The resilience of the damper allows it to deform to the passages shape as it is inserted and urges the contact regions against sides of the passage so providing and/or increasing the contact load on the contact regions. This increases the friction generated due to induced sliding so improving the damping provided by the damper.

Preferably the blade is arranged in use to rotate about a rotational axis, and the contact regions of the damper are arranged to be circumferentially directed with respect to the rotational axis.

Circumferentially directing the contact regions means that vibration under many different modes, and in particular edgewise vibration results in relative sliding of the contact regions. The damper is therefore effective in damping edgewise vibration as well as other vibrational modes (flap and torsional).

Preferably in use the blade and damper are arranged to rotate about a rotational axis and the damper is arranged in use so that the contact regions are urged against the sides of the blade core passages and a contact load is provided, at least in part, by centrifugal forces caused in use by the rotation of the blade and damper.

The contact regions of the damper may be arranged so that, when the damper is inserted within the blade, the contact regions are only in contact with the sides of the passages when, in use, the blade and damper are rotating.

Preferably the damper is resilient with the resilience of the damper arranged, when the damper is inserted within the core passage, to urge the contact regions against the sides of the passage and provide a contact load.

Preferably at least a portion of the head portion of the damper is tapered and an opening of the passage within which the damper is arranged to be inserted is chamfered, the tapered portion of the head portion and the chamfered opening correspond to each other and are arranged so that they engage each other when the damper is inserted within the passage.

BRIEF DESCRIPTION OF THE DRAWINGS

The present invention will now be described, by way of example, with reference to the accompanying drawings in which.

DETAILED DESCRIPTION OF THE INVENTION

Figure 1:
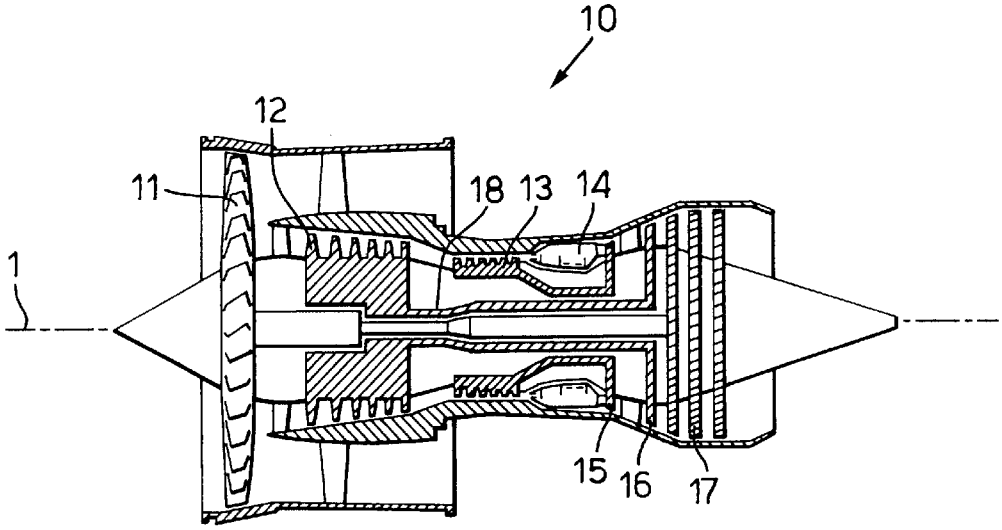
FIG. 1 is a schematic cross sectional view of a gas turbine engine having a plurality of damping members in accordance with the present invention.

With reference to FIG. 1 a ducted fan gas turbine engine generally indicated at 10 is of conventional configuration comprising, in axial flow series, a fan 11, intermediate pressure compressor 12, high pressure compressor 13, combustion equipment 14, high pressure turbine 15, intermediate pressure turbine 16 and a low pressure turbine 17 all disposed about an engine axis 1.

The intermediate pressure turbine 16 serves to drive the intermediate pressure compressor 12 via a shaft 18. The intermediate pressure turbine 16 comprises a conventional disc 19 that rotates with the shaft 18 about the engine axis 1. The peripheral region of the disc 19 carries an annular array of similar radially extending aerofoil blades 20. Each aerofoil blade 20 comprises an aerofoil portion 19 that is exposed to a high energy gas flow flowing though the engine 10, and a fir tree axial cross-section configuration root portion 21 that enables the blade 20 to be located in a correspondingly shaped slot 22 provided in the disc 19 peripheral region. When the blade 20 is fitted a circumferential lockplate 32 closes the end of the slot 22 preventing the blade root 21 from sliding out of the slot 20. Such fir tree configuration roots 21 are well known and serve to provide effective and secure fixing of each aerofoil blade 20 on the disc 19.

The blades 20 are hollow and are provided within an internal core passage 30. This reduces the weight of the blades 20. In addition cooling air, which is bled from the relatively cool compressor sections 12, 13 is directed through ducts 34 within the disc 19 to the roots 21 of the blades 20 and to the core passages 30 within the blades 20, as shown by arrow 35 in FIG. 3. The lock plate 32 seals the slot 22 to this cooling air flow which, as shown by arrow 36, then flows through the core passages 30 and through outlet holes (not shown) within the aerofoil portion 19 of the blade 20. This flow of cooling air within the core passage 30 provides cooling of the blade 20 which is exposed to the high energy and temperature of the gas stream flowing through the turbines 15, 16, 17, downstream from the combustor 14. Such cooling passages 30 and hollow turbine blades 20 are well known in the art. The passages 30 within the blades 20 generally extend throughout a substantial length of the blade 20. Passages with a number of different cross sections are known including circular, rectangular, and square cross sections. It is also known for the passages 30 to have a cross section corresponding to the blade profile such that an outer wall of the blade 20 defines an internal void and passages within the blade 20. The passage 30 dimensions and cross section may also vary along the length of the blade 20 and in particular may be different within the root portion 21 of the blade 20 as compared to that within the airfoil portion 19 of the blade 20. It is also common for the central axis of the passages 30 extending radially outwards to be curved both circumferentially and axially with respect to the engine axis 1, so that the passages 30 are curved as they extend within the length of the blade 20.

Figure 2:
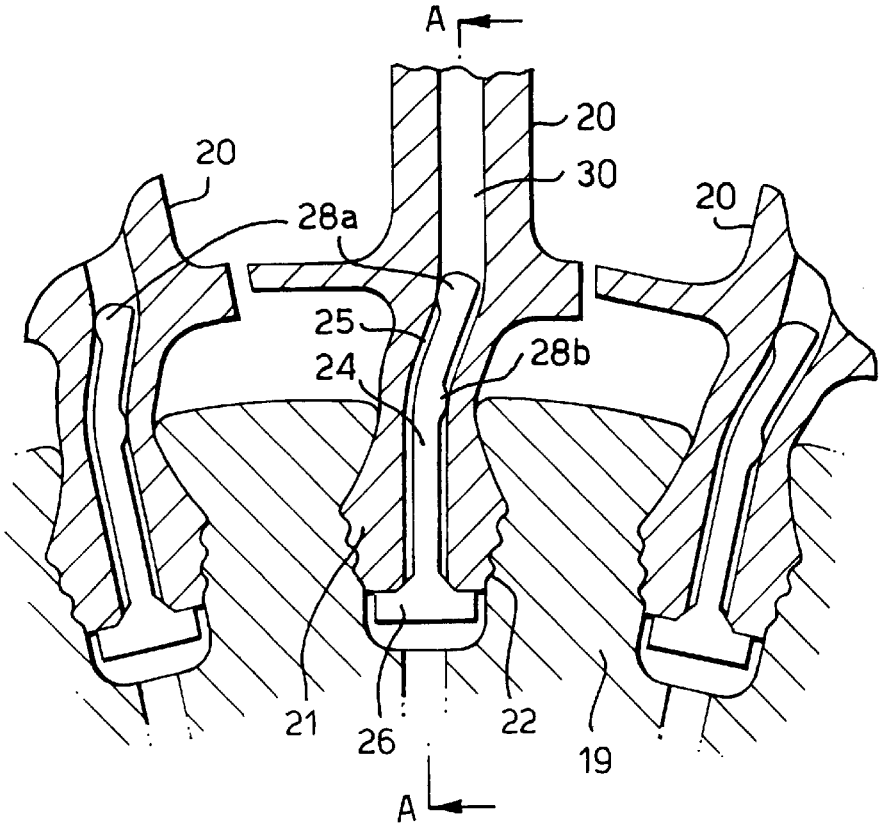
FIG. 2 is a sectioned axial view of a portion of one of the turbine discs/aerofoil blade assemblies of the gas turbine engine shown in FIG. 1 which is provided with a damping member in accordance with the present invention.
Figure 3:
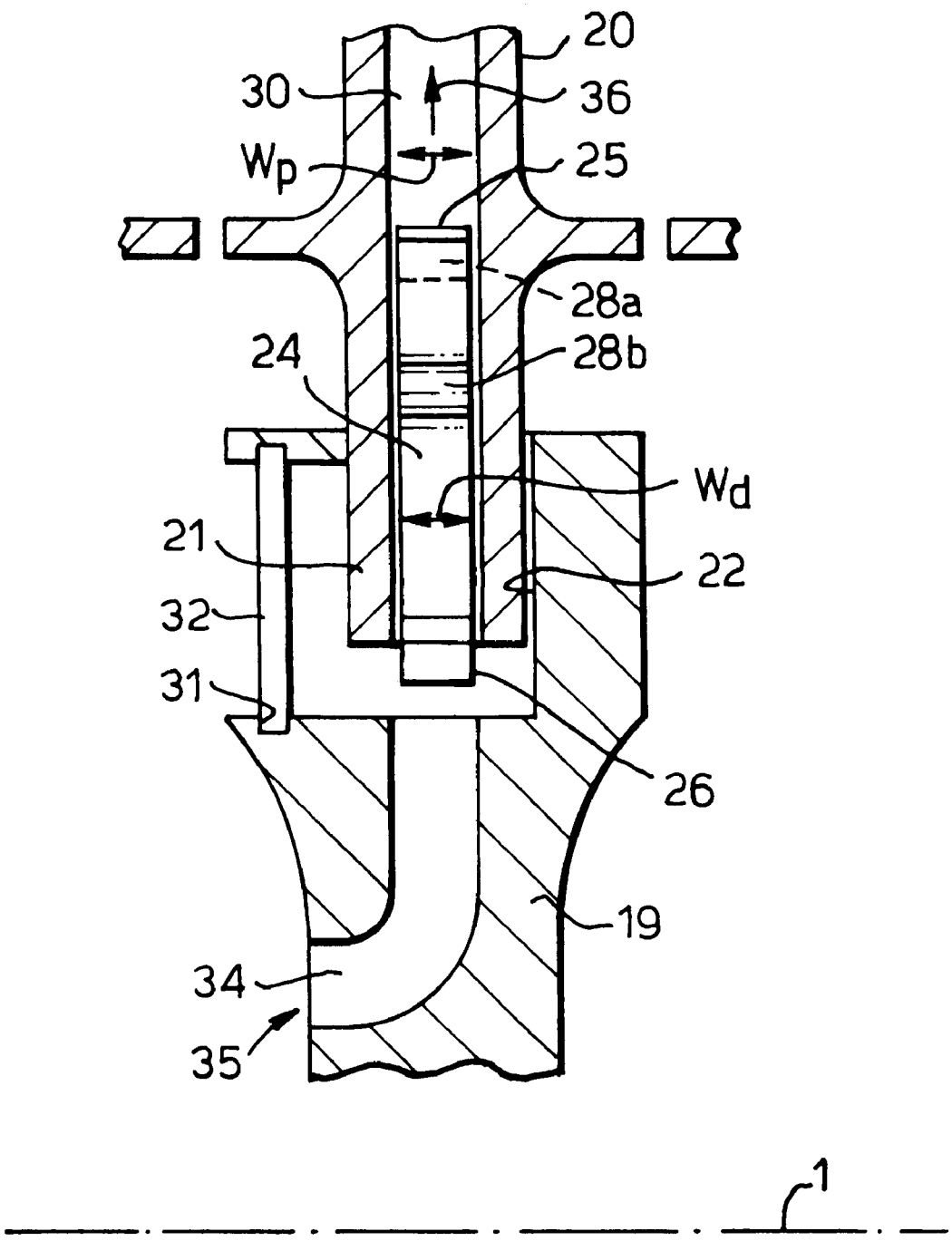
FIG. 3 is a sectional side view, in the direction of lines 3—3, of a portion of one of the turbine discs/aerofoil blade assemblies of the gas turbine engine shown in FIG. 2.

Referring to FIGS. 2 and 3, a damper 25 is inserted, through the root 21 of the blade 20, within the core passages 30. The main body 24 of the damper 25 comprises an initially straight elongate plate which is smaller than the dimensions of the passages 30 and has a degree of flexibility and resilience. In particular the width Wd of the damper 25 is less than the width Wp of the passage 30. Cooling air 36 can therefore flow around the damper 25 and through the passage 30. The core passages 30 within the blade 20 are curved along their radial length and as the damper 25 is inserted the damper 25 bends to conform to and fit within the shape of the passages 30. At one end of the damper 25 there is a head portion 26 comprising a flange extending from the main body 24. This head 26 is arranged to span the core passage 30 and engages the face of the root 21 around the passage 30 to locate the damper 25 to the blade root 21. Along the length of the damper 25 contact pads 28*a*, 28*b* are provided which extend from the main body 24 of the damper 25. Local thickening of the damper 25 is provided by the contact pads 28*a*, 28*b* which bear against the sides of the passage 30 providing contact regions between the damper 25 and the passage 30.

The contact pads 28*a*, 28*b* are positioned along the damper 25 at the points where the damper 25 bends and curves to conform to and fit within the passage 30 curvature.

Although only two contact pads 28*a*, 28*b* have been shown in FIGS. 2 and 3 it will be appreciated that the length of the damper 25 could be increased with further contact pads 28*a*, 28*b* being provided at further points (inflexion points) along the length of the damper 25 where the damper bends. It should also be noted that the contact pads 28*a*, 28*b* and the local thickening of the damper which they provide will also contribute to bending of the damper 25 when inserted and constrained within the passages 30.

Since the damper 25 is initially straight the bending and resilience of the damper 25 as it is inserted urges the contact pads 28*a*, 28*b* against the passages 30. As shown the contact pads 28*a*, 28*b* are accordingly positioned on alternate opposite sides of the main plate body 24 of the damper 25 and bear against opposite sides of the blade core passage 30. The damper 25 is arranged within the passages 30 edge on to the engine axis 1 such that the width Wd of the damper 25 is in the axial direction and the contact regions provided by contact pads 28*a*, 28*b* are circumferentially directed (with respect to the engine axis 1) to bear against circumferentially opposite sides of the passages 30.

In operation the turbine 16 and in particular disc 19, and blades 20 thereon rotate at high speed about the engine axis 1. The blades 20 are also subject to a high energy gas stream flowing downstream from the combustor 14. These factors and other engine resonances or other energy inputs may induce vibration of the blade 20, and in particular of the aerofoil portion 19 of the blade, about the fixed root 21.

The blade root 21 is securely located within the relatively stiff and rigid disc 19. The blade root 21 is therefore fixed relative to the disc 19 and will not move under the vibrational loads which cause displacement of the airfoil portion 19 of the blade. The end of the damper 25 closest to the blade root 21 is securely fixed to the blade root 21 and the disc 19, and therefore similarly its position is fixed relative to the disc 19 and blade root 21. Furthermore circumferential loading on the damper 25 increases the engagement of the head 26 with the blade root 21 increasing the rigidity of the fixing of the damper 25 to the root 21. The head 26 may also be further fixed to the root 21 by welding, brazing or mounting bolts or fasteners. This, the configuration of the damper 25 and its positioning within the passage 30 mean that when the blade 20 vibrates the resulting deflection of the airfoil 19 portion of the blade 20 causes relative displacement of the portion of the damper 25 not fixed or secured to the blade root 21. This results in sliding between the contact regions, provided by the contact pads 28*a*, 28*b*, and the sides of the passages 30 against which they bear. The friction generated by such sliding absorbs energy and will tend to dampen the vibration.

Due to the edgewise arrangement of the damper 25 and the circumferentially directed contact regions vibration of the blade 20 under flap, torsional and also edgewise vibration modes will all result in sliding between the contact regions and the core passages 30. Hence the damper 25 provides damping of vibration under these different vibration modes.

The resilience of the damper and curvature urge the damper 25 contact pads 28*a*, 28*b* against the passage 30 sides. In addition in this embodiment centrifugal loading upon the damper 25 due to the rotation of the turbine 16 tends to straighten the damper 25 within the core passages. This increases the contact load on the contact pads 28*a*, 28*b* which increases the friction generated by any vibration and so the resultant damping provided.

The degree of vibration is generally proportional to the rotational speed of the turbine 16. The centrifugal loading, and so the damping provided, is also proportional to the rotational speed of the turbine 16. Consequently the damper 25 provides a degree of reactive damping which increases with the likely increase in vibration caused by increased rotational speed of the turbine 16.

It will be appreciated that in other variations of this embodiment the contact pads 28*a*, 28*b* could be omitted. In such an arrangement, due to the curvature of the damper 25 and/or passage 30, distinct portions (contact regions) of the body 24 of the damper will contact the sides of the passage 30.

The passages 30 may also be straight rather than curved. In such a case an initially curved damper is used which will tend to be straightened when inserted into the passage. The resulting deformation of the damper and its resilience will urge the contact pads 28*a*, 28*b* or contact regions against the sides of the passage 30 to provide a contact load in a similar way to a straight damper within a curved passage 30. It should be noted though that with a radially straight passage 30 the contact loads will not necessarily be increased by centrifugal loading.

Figure 7:
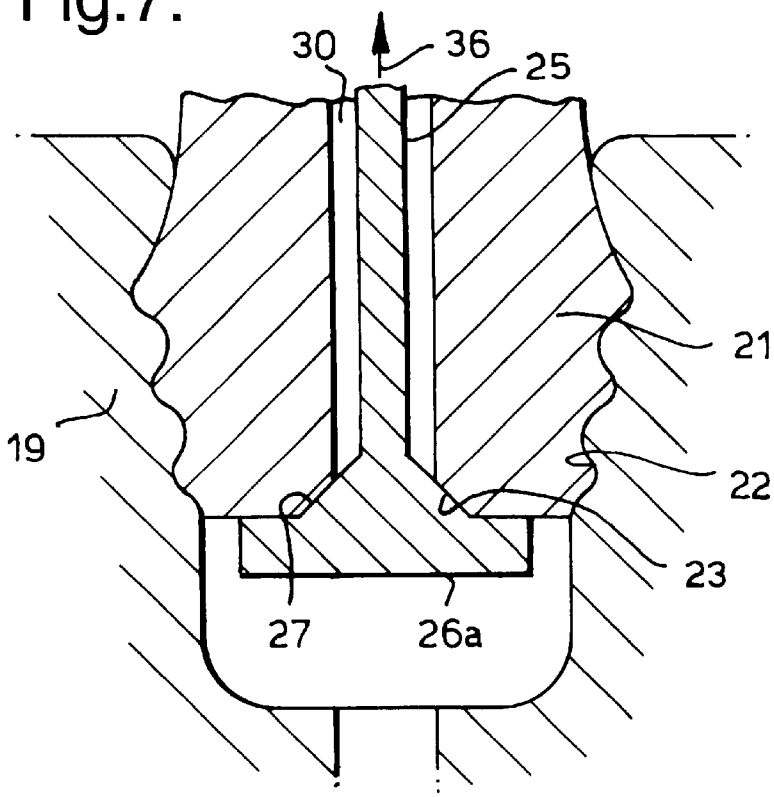
FIG. 7 is a detailed sectional view of the root portion of the blade assembly of a variant of the blade root and damper similar to that shown in FIG. 2.

The damper 25 is securely located to the root 21 of the blade 20 by a head 26 as described above. An alternative arrangement for securely locating the head 26 of the damper 25 and the damper 25 is shown in FIG. 7. In this figure the same reference numerals as used in the embodiment shown in FIG. 2 have been used for similar features and only the difference will now be described. As shown the opening 23 of the blade passage 30 in the root 21 of the blade 20 is chamfered. The head 26*a* of the damper 25 has a corresponding tapered profile portion 27 and when the damper 25 is fitted into the blade passage 30 the tapered portion 27 of the head 26*a* is arranged to engage with the chamfered profile of the passage opening 23 in the root 21 of the blade 20. The engagement of the tapered head portion 27 with the chamfered opening 23 securely locates the head 26*a* to the root of the blade 21. Furthermore in operation centrifugal forces will tend to urge the damper 25 radially outwards, as indicated by arrow 36. This will increase the engagement of the tapered head portion 27 of the damper 25 with the chamfered opening 23 and will more securely and rigidly locate the damper 25 within the passage 30.

Figure 4:
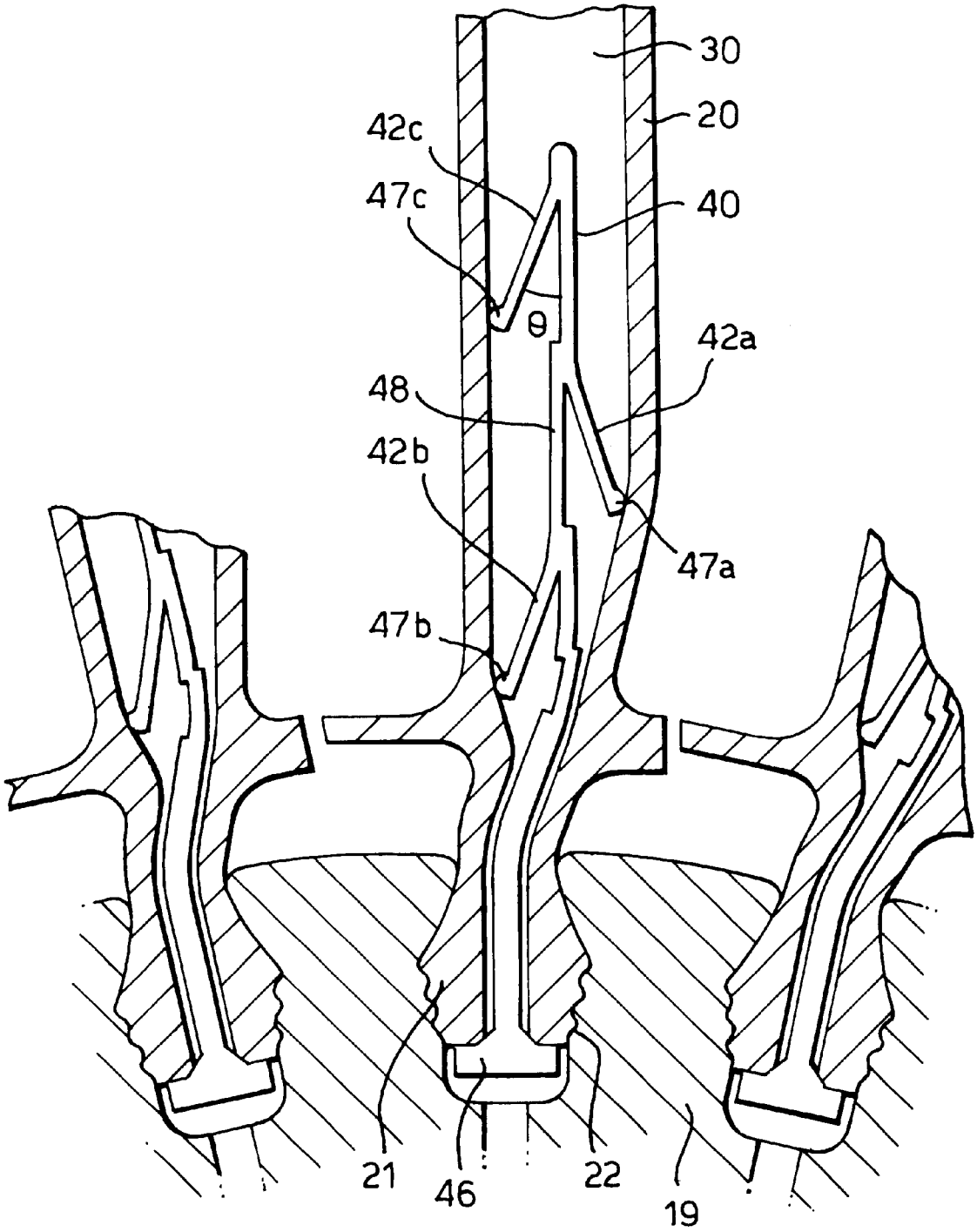
FIG. 4 is a sectioned axial view similar to FIG. 2 of one of the turbine discs/aerofoil blade assemblies incorporating damping members according to a second embodiment of the present invention.
Figure 5:
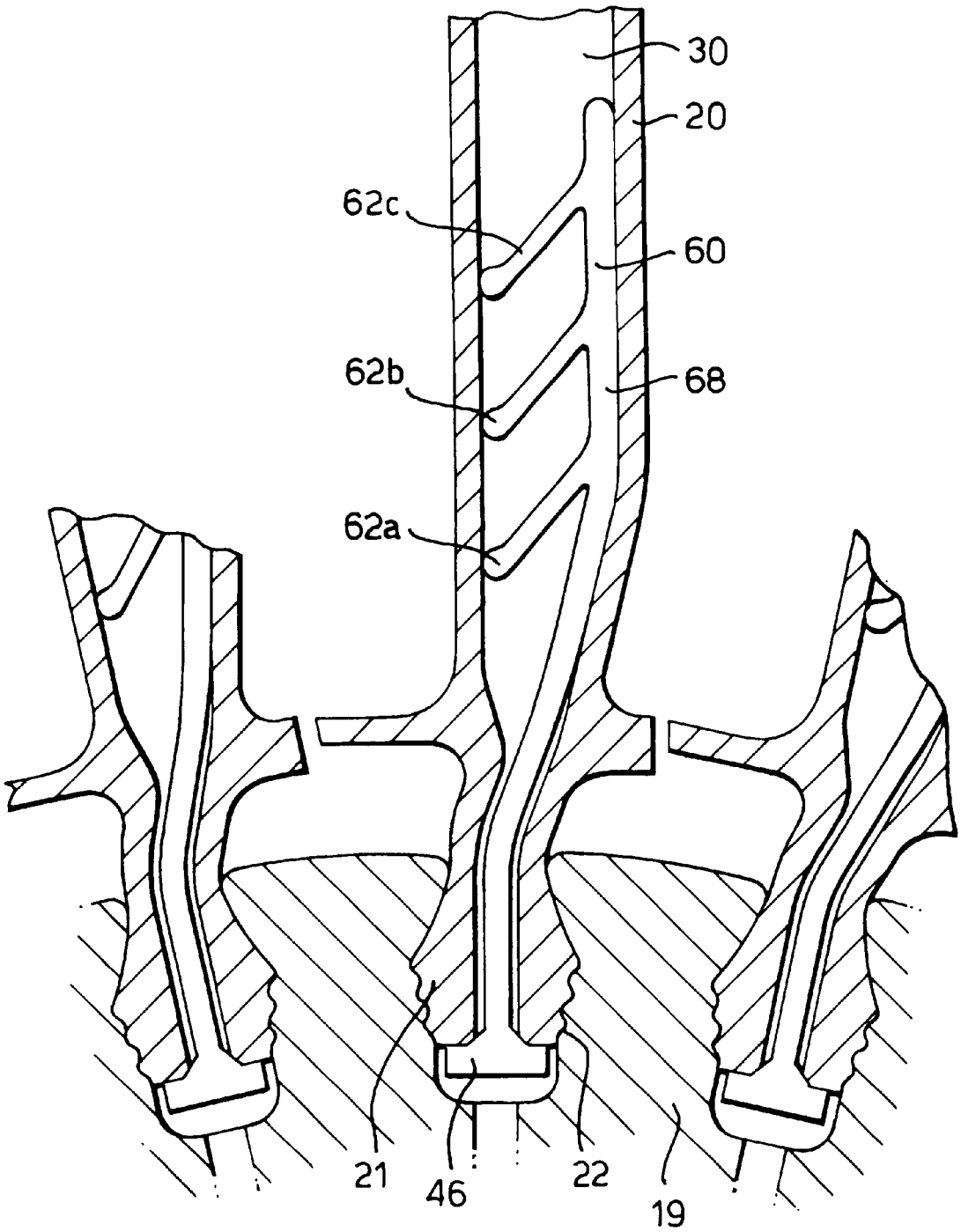
FIG. 5 is a sectioned axial view similar to FIG. 2 of one of the turbine discs/aerofoil blade assemblies incorporating damping members according to a third embodiment of the present invention.
Figure 6:
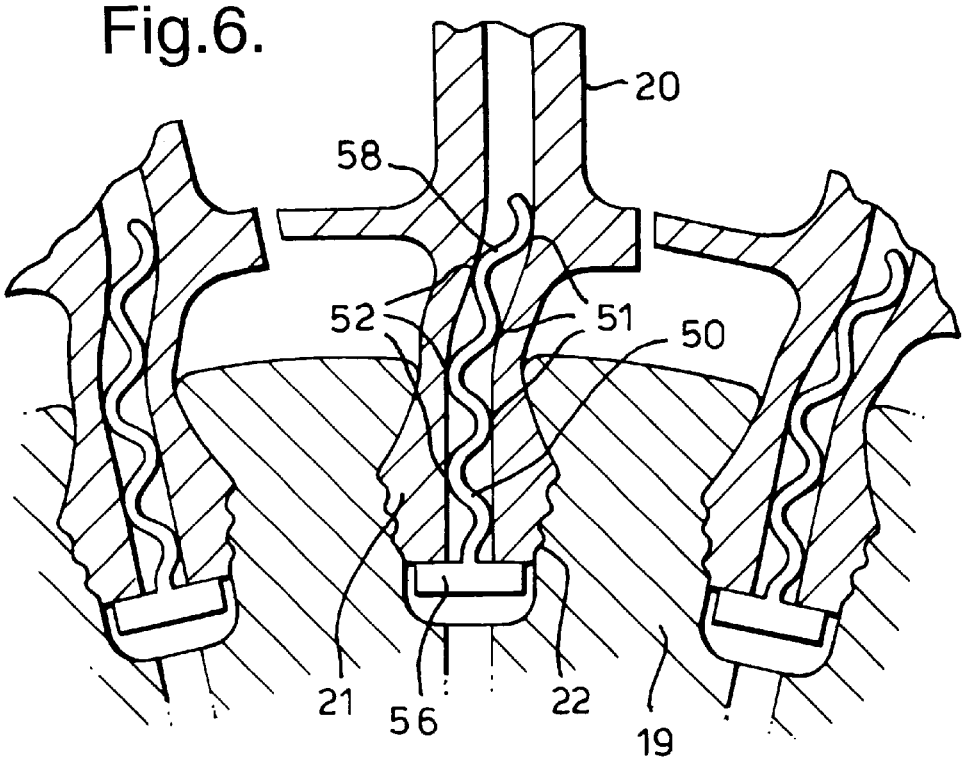
FIG. 6 is a sectioned axial view similar to FIG. 2 of one of the turbine discs/aerofoil blade assemblies incorporating damping members according to a forth embodiment of the present invention.

Further embodiments of the invention comprising different variations to the damper 25 inserted within the core passages 30 of turbine aerofoils 20 are shown in FIGS. 4, 5 and 6. These are generally similar to the embodiment described above and shown in FIGS. 1, 2 and 3 and like reference numbers have been used for like items.

Referring to FIG. 4 the damper 40 comprises an elongate plate providing a main damper body 48. The damper 40 is again flexible, resilient and initially straight. As the damper 40 is inserted into the curved core passage 30 it bends and curves to conform to the shape of the passage 30. It should be appreciated though that the core passages 30 could be straight and with this embodiment a curved passage and/or curved damper is not required. A head 46 securely and rigidly locates one end of the damper to the root 21 of the aerofoil and disc 19. Extending from opposite, alternate, sides of the main body 48 are a number of arms which extend at an angle θ to the main body 48 of the damper 40. The distil ends 47*a*, 47*b*, 47*c* of the arms are thickened and provide multiple contact regions of the damper 40 against the sides of the passage 30. The arms 42*a*, 42*b*, 42*c* are also flexible and resilient and are arranged to spring outwards from the main damper body 48 thereby urging the ends 47*a*, 47*b*, 47*c* of the arms 42*a*, 42*b*, 42*c* against opposite the sides of the core passage 30. The damper 40 is inserted into the core passages 30 edge on with respect to the engine axis 1 such that the width Wd of the damper 40 is in the direction of the engine axis 1. Accordingly the arms 42*a*, 42*b*, 42*c* extend out from the main body 48 in a generally circumferential direction and the contact regions are circumferentially directed.

The operation of the damper 40 is generally similar to that of the previous embodiment with any induced vibration of the blade 20 generating friction due to sliding movement between the contact regions (ends 47*a*, 47*b*, 47*c* of the damper arms 42*a*, 42*b*, 42*c* ) and the sides of the passage 30, thereby damping the vibration. In this embodiment the resilience of the outwardly sprung arms 42 urges the ends 47*a*, 47*b*, 47*c* of the arms 42*a*, 42*b*, 42*c* against opposite sides of the passages 30 thereby providing a contact load, normal to the sides of the passages, on the contact regions (ends 47*a*, 47*b*, 47*c* of the damper arms 42*a*, 42*b*, 42*c* ) . This causes/increases the friction generated under the sliding motion of the contact regions.

The arms 42*a*, 42*b*, 42*c* are angled towards the root 21 end of the damper 40, as shown in FIG. 4. This makes inserting the damper 40 into the passages 30 easier since the arms 42*a*, 42*b*, 42*c* fold back towards the main body 48 as the damper 40 is inserted through the small passage opening. Once inserted the arms 42*a*, 42*b*, 42*c* then spring outwards to bear against the sides of the passage 30.

Due to the angling of the arms 42*a*, 42*b*, 42*c* centrifugal loading of the damper 40 during operation causes the arms 42*a*, 42*b*, 42*c* to open out, increasing the contact load between the contact region at the ends 47*a*, 47*b*, 47*c* of the arms 42*a*, 42*b*, 42*c* and the passage 30 sides. This increases the friction generated thereby increasing the level of damping provided by the damper 40 as the rotational speed, and so vibration, increases. The damper is therefore reactive to some degree.

The centrifugal loading can be further increased by adding additional masses to the ends 47*a*, 47*b*, 47*c* of the arms 42*a*, 42*b*, 42*c* . This increases the contact load between the contact region at the ends 47*a*, 47*b*, 47*c* of the arms 42*a*, 42*b*, 42*c* and the passage 30 sides produced during operation so increasing the reactive damping provided.

A variation of the damper 40 embodiment described above is shown in FIG. 5. In this variation the damper 60 has arms 62*a*, 62*b*, 62*c* that extend from only one side of a main damper body 68. These arms 62*a*, 62*b*, 62*c* are outwardly sprung and the ends are urged and bear against one side of the passage 30. The opposite side of the main damper body 68 is arranged to abut against the opposite side of the passage 30 and is urged thereagainst by the outwardly sprung arms 62*a*, 62*b*, 62*c*. In this variation the contact regions of the damper 60, which are arranged to slide against the sides of the passage 30, are provided by both the ends of the arms 62*c*, 62*b*, 62*c* and the whole of one side of the damper main body 68. The operation of this damper 60 though is similar to the damper 40 described with reference to FIG. 4.

In a further variation of these two embodiments shown in FIGS. 4 and 5 the centrifugal loading can be used substantially alone to provide a contact load between the contact regions of the damper and the sides of the passages 30. In such arrangements the flexible arms 42*a*, 42*b*, 42*c* of the damper 40, 60, when inserted into the blade 20, do not extend all the way to the sides of the passages 30. In operation though centrifugal loading will urge and move the arms 42*a*, 42*b*, 42*c* outwards, away from the main body 48, so that they extend to the sides of the passages 30 with the ends 47*a*, 47*b*, 47*c* of the arms being urged against the sides of the passages 30. A contact load between the ends 47*a*, 47*b*, 47*c* of the arms and the sides of the passages is thereby provided during operation to generate friction in response to any vibration, which will in turn damp that vibration. An advantage of this arrangement is that the insertion and removal of the damper within the blade 20 is easier since the damper, when stationary, is not in contact with the core passage 30. To this end the arms 42*a*, 42*b*, 42*c* are preferably arranged not to extend further than the width of the blade passage 30 opening through which they are inserted.

In a further embodiment of the invention, shown in FIG. 6, the damper 50 comprises a flexible resilient corrugated plate 58 which is inserted within the blade 20 core passage 30. The plate 58 is again arranged within the passage 30 edge on with respect to the engine axis 1. A head portion 56 is provided at one end of the damper 50 and secures the damper 50 to root 21 of the blade 20 and therethrough to the disc 19. The maximum 51 and minimum 52 points of the corrugations are circumferentially directed and abut against opposite sides of the passage 30 to provide the contact regions of the damper 50. The corrugations and resilience of the damper are arranged such that when inserted within the passages the contact regions 50, 51 of the corrugations are urged against the passage 30 sides providing a contact load at the contact regions. Since the damper 50 is fixed only at one end any induced vibration of the blade 20 during operation causes sliding motion between the contact regions of the damper 50 and the sides of the passage 30. This generates friction which dissipates the vibrational energy providing damping of the vibration. The friction generated and so degree of damping provided is proportional to the contact load which in this embodiment is determined by the shape of the corrugations and the resilience of the damper 50. The damper 50 is arranged to have an interference fit within the core passage 30 which provides the required contact loads. This embodiment is simpler to manufacture than the dampers 25, 40, 60 of the previous embodiments shown in FIG. 4, 5,and 6 and in operation provides similar damping of all vibrational modes including edgewise vibration. The damper 50 is not though as reactive as the dampers shown in FIGS. 4, 5, and 6. The damper can also be with both curved or straight passages 30. As shown the corrugations of the damper 50 run axially. However in a variation of this damper 50 the corrugations could run radially along the length of the damper 50 such that the contact regions extend radially along the core passage 30 when the damper is inserted within the blade 20.

It will be appreciated that with all of these dampers 25, 40, 50, 60 the sliding motion of the contact regions and the sides of the passage 30 will result, overtime, in wear. The blades 20 are considerably more expensive than the dampers 25, 40, 50, 60 and are also subject to the high temperature gas stream. Wear of the sides passages 30 will weaken the blade 20 and necessitate replacement of the blade 20. Therefore the contact regions of the damper 25, 40, 50, 60, which is considerably cheaper to replace, are made from a suitable material such that they wear in preference to the sides of the passages 30 within the blades 20.

In all of the embodiments at least two discrete contact regions are provided where the damper 25, 40, 50, 60 abuts against the sides of a blade passage 30 and where any induced vibration, under different vibrational modes, produces sliding motion which generates friction to dissipate and damp the vibration. By providing discrete multiple contact regions, as opposed to a large single contact surface, the damper 25, 40, 50, 60 is easier to fit into the core passage 30. Sliding between the contact regions and the sides of the core passage 30, which is required to produce the damping effect also occurs more readily when multiple discrete contact regions are used resulting in improved damping. The level of friction produced by the sliding is proportional to the contact load. In the prior art arrangements this contact load is determined primarily by the interference fit between the damper and the sides of the core passage. To allow assembly this interference fit and so contact load is limited. Using multiple discrete contact regions and a resilient damper arrangement as described which is arranged to urge the contact regions against the sides of the passages 30 the contact loads can be increased resulting in increased friction generation and improved damping.

The contact regions of the dampers 25, 40, 50, 60 and the contact loads are circumferentially directed. The contact regions also extend axially parallel to the engine axis 1. This along with the overall damper 25, 40, 50, 60 arrangement provides a damper 25, 40, 60 that is effective in damping torsional, flap and, significantly, edgewise modes of vibration that may be induced in the blade 20.

In order for the dampers 25, 40, 50, 60 to damp the vibration contact loads need to be provided, at least when in use, at the contact regions between the damper and blade passages 30. In the above described embodiments such contact loads are provided in three main ways. Firstly the contact loads can be generated by the interference fit of the damper within the passage. Secondly the contact loads can be provided by the resilience of the damper urging the contact regions against the core passages 30. In the third method centrifugal forces, which are generated during engine operation, are arranged to urge the contact regions of the damper against the sides of the passage and provide contact loads. As described and illustrated in the above embodiments these different methods of providing contact loads can be used individually and/or in combination with each other in various embodiments of the invention.

Another advantage of the dampers 25, 40, 60 shown in FIGS. 2, 3, 4, and 5 is the reactive nature of the damping provided. With these dampers 25, 40, 60 the contact loads, and so damping, increase with rotational speed. At higher speeds increased induced vibration can be expected. The damping effectiveness of the damper 25, 40, 60 accordingly varies in anticipation of increased vibration.

It will be appreciated by those skilled in the art that although the present invention has been described with reference to damping intermediate pressure turbine blades it can be applied to damping other turbine blades and also to similarly damping compressor blades of a gas turbine engines.

Although the core passages 30 within which the damper is inserted are preferably blade cooling passages 30, dedicated passages for the damper within the blade could be used in alternate arrangements. In particular dedicated passages would be required with blades which have no cooling requirement and so have no cooling passages. The use however of the blade 20 cooling passages 30 is desirable since this makes the blade arrangement simpler and cheaper to manufacture. Such dedicated passages could have a wide range of configurations and shapes which could be optimised to interact with the damper. When dedicated passages are used there is no requirement for the damper to allow cooling air to flow through the passage sand passed the damper. Consequently the damper can fill the entire passage 30. The damper can also fill a portion of the entire passage 30 even if the passage 30 is used for cooling provided that a further supply duct for the cooling air to the unobstructed portion of the passage 30 is provided. For example a further passages can be provided which interconnects with the cooling passage 30 within the damper is fitted.

It will also be appreciated that a number of variations and different embodiments of the invention can be produced without departing from the spirit or scope of the invention.

What is claimed is:

1. An aerofoil blade damper for use with an aerofoil blade which has a blade root and a core passage defined in the blade root and blade which extends within the blade root and blade, the damper comprising an elongate member which in use is arranged to be retained in the blade at one end which is closest to the blade root with the remainder of the damper free to move relative to and within the passage; wherein the damper comprises a resilient plate insert upon which there are provided at least two discrete substantially oppositely directed contact regions which are arranged, in use, to frictionally engage the passage, the damper being curved along its length.

2. An aerofoil blade damper for use with an aerofoil blade which has a blade root and a core passage defined in the blade root and blade which extends within the blade root and blade, the damper comprising an elongate member which in use is arranged to be retained in the blade at one end which is closest to the blade root with the remainder of the damper free to move relative to and within the passage; wherein the damper comprises a resilient plate insert upon which there are provided at least two discrete substantially oppositely directed contact regions which are arranged, in use, to frictionally engage the passage, said contact regions comprising protrusions from the plate insert.

3. An aerofoil blade damper as claimed in claim 1 in which the resilience of the damper is arranged to permit the damper to bend to conform to the shape of the blade passage within which the damper is arranged to be inserted.

4. An aerofoil blade damper as claimed in claim 3 in which the resilience of the damper is arranged such that the contact regions of the damper are urged against the sides of the passages and provides a contact load between the contact regions and the blade passage, when the damper is inserted within the blade passage.

5. An aerofoil blade damper as claimed in claim 1 in which in use the blade and damper are arranged to rotate about a rotational axis and the damper is arranged in use and is sufficiently resilient that centrifugal forces caused by the rotation bend and deflect at least a part of the damper to urge the contact regions against the sides of the passages.

6. An aerofoil blade damper as claimed in claim 1 in which the plate insert is corrugated with the corrugations disposed transversely across the plate.

7. An aerofoil blade damper as claimed in claim 6 in which the contact regions comprise the maximum and minimum extents of the corrugations which are arranged in use to frictionally engage the passage.

8. An aerofoil blade damper as claimed in claim 1 in which the plate insert is corrugated with the corrugations disposed at an angle relative to an axis of the plate.

9. An aerofoil blade damper as claimed in claim 1 in which the plate insert is corrugated with the corrugations disposed longitudinally.

10. An aerofoil blade damper as claimed in claim 1 in which the protrusions comprise arcuate profiled pads where the thickness of the plate insert is increased.

11. An aerofoil blade damper as claimed in claim 1 in which the protrusions comprise flexible arms extending from the plate insert, with the distal ends of the arms arranged in use to frictionally engage the passage.

12. An aerofoil blade damper as claimed in claim 11 in which the arms are angled in the direction of the end of the damper arranged to be closest to the blade root.

13. An aerofoil blade damper as claimed in claim 11 in which an additional mass is provided at each of the distil ends of the arms.

14. An aerofoil blade damper as claimed in claim 1 in which the protrusions extend from only on side of the plate, the protrusions and the opposite side of the plate arranged to provide the contact regions which, in use, frictionally engage the passage.

15. An aerofoil blade damper as claimed in claim 1 in which the successive contact regions are arranged alternately along the length of the damper.

16. An aerofoil blade damper as claimed in claim 1 which is arranged to be used with a turbine blade.

17. An aerofoil blade damper as claimed in claim 1 in which the core passage within which the damper is arranged to be inserted comprises a cooling passage within an aerofoil blade.

18. An aerofoil blade damper as claimed in claim 1 in which the core passage within which the damper is arranged to be inserted comprises a dedicated passage within an aerofoil blade for the damper.

19. An aerofoil blade damper as claimed in claim 1 in which at an end of the damper arranged to be closest to the blade root a head portion extends from the plate insert, the head portion is arranged to span the width of the passage to thereby provide retention of the damper when inserted into a blade.

20. An aerofoil blade damper as claimed in claim 19 in which the head portion and damper are arranged to allow an airflow through the passage.

21. An aerofoil blade damper as claimed in claim 19 in which at least a portion of the head portion of the damper is tapered and an opening of the passage within which the damper is arranged to be inserted is chamfered, the tapered portion of the head portion and the chamfered opening correspond in shape with each other and are arranged so that they engage each other when the damper is inserted within the passage.

22. An aerofoil blade damper as claimed in claim 1 in which a cross sectional area, perpendicular to the length of the damper, of a portion of the damper arranged to be inserted within the passage is less than the cross sectional area of the passage, perpendicular to the longitudinal direction of the passage, and within which the damper is arranged to be inserted.

23. An aerofoil blade damper as claimed in claim 1 in which the core passage within which the damper is arranged to be inserted is curved.

24. An aerofoil blade damper as claimed in claim 1 in which the blade is arranged in use to rotate about a rotational axis, and the contact regions of the damper are arranged to be circumferentially directed with respect to the rotational axis.

25. An aerofoil blade damper as claimed in claim 24 in which the contact regions of the damper are arranged so that, when damper is inserted within the blade, the contact regions are only in contact with the sides of the passages when, in use, the blade and damper are rotating.

26. An aerofoil blade damper as claimed in claim 1 in which in use the blade and damper are arranged to rotate about a rotational axis and the damper is arranged in use so that the contact regions are urged against the sides of the blade core passages and a contact load is provided, at least in part, by centrifugal forces caused in use by the rotation of the blade and damper.

* * * * *